US007203283B1

(12) United States Patent
Puusaari

(10) Patent No.: US 7,203,283 B1
(45) Date of Patent: Apr. 10, 2007

(54) X-RAY TUBE OF THE END WINDOW TYPE, AND AN X-RAY FLUORESCENCE ANALYZER

(75) Inventor: Erkki Tapani Puusaari, Espoo (FI)

(73) Assignee: Oxford Instruments Analytical Oy, Espoo (FI)

( * ) Notice: Subject to any disclaimer, the term of this patent is extended or adjusted under 35 U.S.C. 154(b) by 0 days.

(21) Appl. No.: 11/358,835

(22) Filed: Feb. 21, 2006

(51) Int. Cl.
*H01J 35/08* (2006.01)

(52) U.S. Cl. ..... 378/143; 378/140

(58) Field of Classification Search ..... 378/119, 378/124, 136, 140, 143, 57
See application file for complete search history.

(56) References Cited

U.S. PATENT DOCUMENTS 6,141,400 A * 10/2000 Schardt et al. ..... 378/124
6,278,115 B1 * 8/2001 Annis et al. ..... 250/363.01
6,463,123 B1 * 10/2002 Korenev ..... 378/69
6,487,272 B1 11/2002 Kutsuzawa

* cited by examiner

*Primary Examiner*—Edward J. Glick
*Assistant Examiner*—Hoon Song
(74) *Attorney, Agent, or Firm*—Wood, Phillips, Katz, Clark & Mortimer

(57) ABSTRACT

In an x-ray tube comprising a housing, which define an enclosure, a cathode arrangement, which emits electrons within the enclosure, and a window, which seals an end of the enclosure, the window comprises a carrier layer and, on a side of the carrier layer that faces the enclosure, a layered anode arrangement having certain characteristics.

9 Claims, 1 Drawing Sheet

X-RAY TUBE OF THE END WINDOW TYPE, AND AN X-RAY FLUORESCENCE ANALYZER

TECHNICAL FIELD

The invention concerns the technical field of controllable x-ray sources that are applicable for use e.g. in measurement systems where X-rays are needed as excitation radiation. Especially the invention concerns adapting the structure of an X-ray tube to comply with requirements of producing radiation of a particular kind.

BACKGROUND OF THE INVENTION

An X-ray tube is a controllable X-ray source, in which electrons detached from a cathode get accelerated in an electric field and hit an anode, where they lose their kinetic energy in various interaction processes with the atoms of the anode material. One result of these interaction processes is the generation of X-rays, the spectrum of which comprises both a continuous part (known as bremsstrahlung) and some prominent peaks. The energies at which the peaks occur depend on the anode material, because the peaks are associated with the relaxation of excited states in the atoms of the anode. Widely used anode materials are include (without being limited to) chromium, copper, molybdenum, rhodium, silver and tungsten. The spectral distribution and intensity of the bremsstrahlung part is proportional to both the acceleration voltage and the atomic ordinal number of the anode material: higher acceleration voltages and heavier anode materials increase the intensity of the continuous spectrum part at higher energies.

An X-ray tube is either of the bulk anode type or of the transmission anode type. A bulk anode is relatively thick and typically designed to direct the generated X-rays out of a separate window in a side surface of the X-ray tube, for which reason also the designation "side window type" is used for these kinds of X-ray tubes. A transmission anode is thin enough to let the generated X-rays pass through it. A transmission anode is typically a thin metal layer on an inner surface of an end window of the X-ray tube, giving rise to the alternative designation "end window type" X-ray tube.

The bremsstrahlung part and peak parts of the excitation spectrum are useful for different purposes for example in X-ray fluorescence analysis, in which the incident X-rays coming from an X-ray tube in turn excite the constituent particles of a target material. The fluorescence analysis involves detecting the fluorescent X-rays that come from the relaxation of excited states in said constituent particles, and using the detection results to make deductions about the presence of various elements in the target. The target may be very heterogeneous in constitution, like a soil sample from which the content of heavy metal pollutants should be measured. The characteristic peaks in the excitation radiation are useful for determining the matrix of ordinary soil constituents, while the high-energy bremsstrahlung part of the spectrum suitably excites the atoms of the heavy metals like lead, cadmium and others.

A problem with selecting the anode material occurs, because an anode material that gives good characteristic peaks does not necessarily give enough bremsstrahlung in the desired energy ranges. As an example we may consider rhodium as anode material. The so-called K lines of rhodium are easily applicable to determining the ratio between coherent scattering and Compton scattering, which enables using effective analytical tools for determining the matrix of a sample, such as soil. However, the amount of bremsstrahlung coming from a rhodium anode is relatively low in the frequency range that would be required to properly excite the atoms of cadmium, which is a typical pollutant to be measured from soil. The intensity of fluorescent radiation that can be obtained from a target material is proportional to the intensity of excitation radiation in the proper frequency range. Thus using a rhodium anode results in a relatively low intensity of fluorescent radiation from cadmium and other heavy metals, which weakens the analytical performance of the X-ray fluorescence analyzer in measuring soil pollution.

SUMMARY OF THE INVENTION

An objective of the present invention is to provide a controllable X-ray source that is capable of producing an excitation spectrum that has both good characteristic peaks and a high intensity of bremsstrahlung. Another objective of the invention is to provide an X-ray fluorescence analyzer that has good analytical performance in measuring the heavy metal content of target samples. Yet another objective of the invention is to provide a versatile anode solution for use in a wide range of end window type X-ray tube applications.

The objectives of the invention are achieved with a layered anode structure, in which a carrier layer supports at least two anode layers made of anode materials with a difference in atomic ordinal number.

According to an aspect of the present invention, by using two anode layers and suitable dimensioning it is possible to achieve a situation, in which some of the accelerated electrons interact within a "heavy" anode layer producing a relatively high amount of bremsstrahlung, while others interact with a "light" anode layer producing at least one prominent characteristic peak at a spectral location characteristic to that anode material.

Characterising the other anode material as "light" only indicates that its atomic ordinal number is smaller than that of the "heavy" anode material; typically the "light" anode material could be for example rhodium, palladium, chromium, copper or molybdenum. Also silver can be used as the "light" anode material, if the measurement is not meant to detect cadmium, this condition being due to certain coincidences in the spectral characteristic of silver and cadmium. Suitable materials for use as the "heavy" anode material are for example tungsten, hafnium, platinum and rhenium.

An X-ray fluorescence analyzer according to an aspect of the invention comprises an end window type X-ray tube, in which the anode is of the multilayer type described above and in which the detection and processing parts are adapted to take advantage of the special form of the resulting excitation spectrum.

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
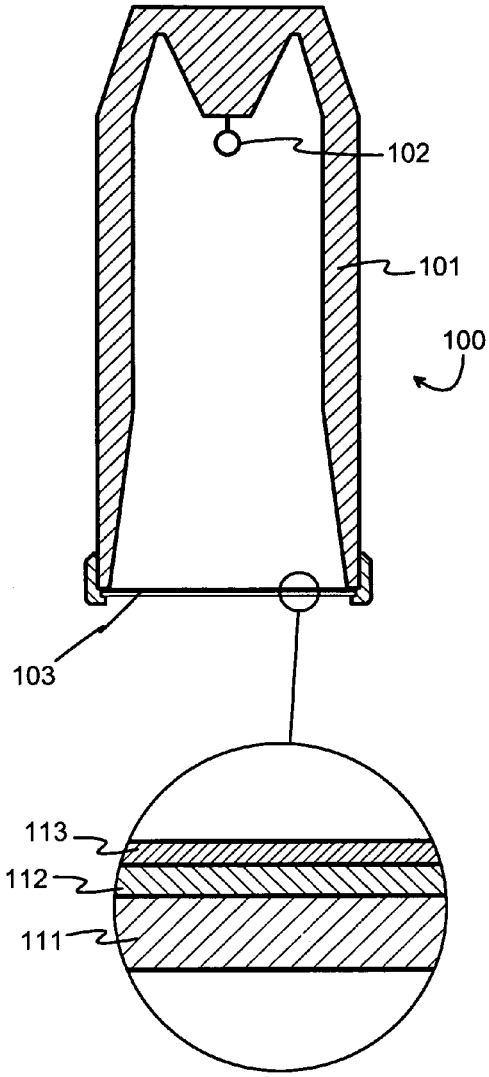
FIG. 1 illustrates an X-ray tube.

FIG. 1 is a schematic cross section of an X-ray tube 100 of the end window type. An airtight housing 101 is designed to maintain essentially vacuum conditions inside it. Within the housing 101 there is a cathode arrangement 102 designed to emit electrons, for example as the result of heating up a cathode wire coupled to a high negative voltage. At one end of the housing 101 there is an end window, which is generally designated as 103. As is seen in more detail in the partial enlargement, the end window 103 has a layered structure. A carrier layer 111 is made of a material that is mechanically strong, chemically stable and permeable to X-rays. A preferred material for the carrier layer 111 is beryllium, but also other materials can be used that are known for their suitability for radiation-passing windows of X-ray tubes.

On the inner surface of the carrier layer 111 there is a layered anode arrangement. A strong electric field between the cathode arrangement 102 and the anode arrangement, caused by the large potential difference between them, is adapted to accelerate the electrons emitted by the cathode arrangement 102 so that they hit the layered anode arrangement. The layer immediately on top of the carrier layer 111 is a first anode layer 112, which corresponds to the "light" anode layer mentioned previously in this description. In order to function as an anode layer it must be made of an electrically conductive material. An even more important characteristic of the first anode layer 112 is that it consists of a material that is known to emit suitable characteristic X-ray lines when subjected to electron bombardment. What is "suitable" in this respect depends on the particular analysis or measurement for which the X-ray tube 100 is meant. As an example we may assume that the first anode layer 112 is made of rhodium, palladium, chromium, copper, molybdenum or silver.

On top of the first anode layer 112 there is a second anode layer 113, which is thus the innermost layer of the end window 103 and faces the vacuum inside the housing 101. Also the second anode layer 113 is electrically conductive, but what is more important, it is made of a material having a larger atomic ordinal number than the material of the first anode layer 112. Exemplary materials of the second anode layer 113 are tungsten, hafnium, platinum and rhenium.

The relative thicknesses of the carrier layer 111 on one hand and the first and second anode layers 112 and 113 on the other hand do not correspond to reality in FIG. 1. The thickness of the carrier layer 111 has relatively little importance to the radiation-emitting characteristics of the X-ray tube 100. Accelerated electrons that hit the end window 103 would only penetrate the material of the carrier layer 111 to a maximum depth of some micrometers. Additionally there are the anode layers on top of it, which means that all carrier layer materials of reasonable thickness completely block any electrons from coming through. On the other hand, known window materials such as beryllium are so transparent to X-rays that even thicknesses of hundreds of micrometers cause practically no absorption at energy levels comparable to the K lines of rhodium, which are a representative example of the X-rays meant here. The thickness of the carrier layer 111 will be selected mainly to achieve sufficient mechanical strength and sufficiently high thermal conductivity. A carrier layer 111 made of beryllium would typically have a thickness between 150 and 800 micrometers, for example 500 micrometers.

The thicknesses of the first and second anode layers 112 and 113 have very much influence to the radiation-emitting characteristics of the X-ray tube 100. The accelerated electrons will hit first the second anode layer 113, which is the "heavy" layer, the task of which is to give rise to high-energy bremsstrahlung of sufficient intensity. However, not all accelerated electrons should interact within the second anode layer 113, but a significant portion should continue to the first, "light" anode layer 112 to generate the characteristic peaks in the excitation spectrum. This means that the thickness of the second, "heavy" anode layer 113 should be remarkably smaller than the maximum penetration depth of accelerated electrons in the material thereof. If tungsten is used as the material of the second anode layer 113, its thickness is preferably not more than 0.5 micrometers, and can be less than that. A lower limit to the thickness of the second anode layer can be found by experimenting; an optimum is a thickness that gives the best balance between bremsstrahlung intensity and characteristic peak intensity for a particular measurement.

Since the material of the first, "light" anode layer 112 is of lower atomic ordinal number, and since the accelerated electrons need not propagate any further, the thickness of the first layer may be greater than the thickness of the second, "heavy" anode layer 113. Principally the thicker the layer 112, the higher intensity of the characteristic peaks will result. However, there is an upper limit concerning this intensity aspect at the maximum penetration depth of accelerated electrons in the material of the first anode layer. If the first anode layer 112 is made of rhodium, it can have a thickness between 0.8 and 1.0 micrometers.

However, certain other considerations may advocate an even thicker first anode layer 112. Since the second, "heavy" anode layer 113 is only there to generate bremsstrahlung of sufficiently high energy, it may be advantageous to filter out some other, undesired wavelengths from the eventual emission spectrum. For example, with a second anode layer 113 made of tungsten, the value of the voltage that accelerates the electrons will be deliberately selected low enough not to excite the K lines of tungsten. The L lines of tungsten will be there and get excited, but making the first anode layer 112 thick enough, more than 1.0 micrometers, may filter these out. An alternative way of filtering would be to use a separate output filter, like a nickel foil, at the output of the X-ray tube. Separate filtering layers such as said nickel foil may be integrated into the layered end window structure either between the first anode layer 112 and the carrier layer 111 or on the outer side of the carrier layer. Alternatively standalone filters can be used, with their own attachment means that facilitate attaching them to the output end of the X-ray tube 100.

When we say that an anode layer is made of a material, this has to be understood in the conventional sense that said material is a principal constituent of said anode layer. Minor amounts of impurities will always exist in all practical anode layers, and in some cases it may prove to be advantageous to even deliberately use some small amounts of alloying constituents. However, all deliberately added component materials have to be taken into account in analysing the measurement results, because they will cause corresponding changes in the characteristics of the emitted X-ray spectrum.

Basically it would be possible to make an anode layer comprise two different materials also by using a homogeneous mixture of the "heavy" and "light" materials to produce a single anode layer, or by making patches of the different materials alternate in the anode layer in some kind of a checkerboard or honeycomb pattern. However, such solutions would not be as advantageous as the one described above that comprises the two anode layers on top of each other, for example because said alternative solutions would not enable using the subsequent anode layer as a filter for filtering out undesired wavelengths generated in the previous anode layer. Also, exposing as much as possible of the heavier anode material to the initial beam of accelerated electrons (i.e. using an essentially continuous "heavy" anode layer on the inner side of the window) enables producing as much of the high-energy end of the bremsstrahlung spectrum as possible; this advantage would be lost in the "mixture" and "checkerboard" alternatives.

Taken that the basic layered approach would be selected, at least theoretically it is possible to build a layered structure in which the transition between layers is not sharp, but the relative contents of the two anode materials would change in some kind of a stepless manner. The strictly layered alternative is still more advantageous, if not for other reasons then for the relative simplicity of manufacturing.

The carefully selected materials and thicknesses of the first and second anode layers, and their consequent effect on the produced excitation spectrum, make an end window according to an aspect of the present invention different from previously known layered window structures. For example a patent U.S. Pat. No. 6,487,272 discloses a beryllium window, tungsten anode and between them an intermediate layer of "other metal than tungsten", examples of the intermediate layer materials being Cu, Fe, Ti, Au, Cr, and Ta, as well as certain combinations thereof. However, the intermediate layer there is much thinner than the actual anode layer of tungsten, and its task is not to affect the excitation spectrum but to strengthen the mechanical bond between the tungsten layer and the beryllium window. The author of said patent has not given the intermediate layer any "anode" function, which means among others that the tungsten layer will be thick enough to keep any significant number of accelerated electrons from even reaching the intermediate layer.

Figure 2:
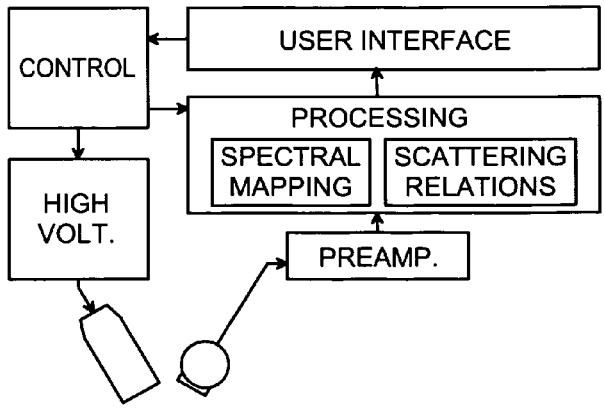
FIG. 2 illustrates an X-ray fluorescence analyzer.

FIG. 2 illustrates schematically an X-ray fluorescence analyzer according to an embodiment of the invention. It comprises a controllable X-ray source, which is an X-ray tube 100 similar to that illustrated in FIG. 1. Additionally it comprises a detector 201 and processing electronics generally designated as 202. In order to take advantage of the special output spectrum characteristics of the X-ray tube 100, the processing electronics 202 comprise a scattering relation processing part 203 adapted to utilise the detected scattering of characteristic peak radiation in a target, as well as a spectral mapping part 204 adapted to detect the presence of fluorescent radiation of particular wavelengths in what comes out of the target. The spectral mapping part 204 has been programmed to take into account the relatively high intensity of high-energy bremsstrahlung that is contained in the output spectrum of the X-ray tube 100. Similarly the scattering relation processing part 203 has been programmed to take into account the characteristic peaks in the form in which they appear in the output spectrum of the X-ray tube 100, due to the specific layered structure of its output window. A control unit 205 is adapted to control the operation of the processing electronics 202 and a high voltage source 206 coupled to the X-ray tube 100. Interaction with a user takes place through a user interface 207.

I claim:

1. An X-ray tube comprising:

a housing, which defines an enclosure, a cathode arrangement adapted to emit electrons within the enclosure, and a window adapted to seal an end of the enclosure;

wherein the window comprises a carrier layer and, on a side of the carrier layer that faces the enclosure, a layered anode arrangement comprising a second anode layer and a first anode layer between the carrier layer and the second anode layer, the material of the second anode layer having a characteristic maximum penetration depth of electrons accelerated between the cathode arrangement and the anode arrangement, and the thickness of the second anode layer being smaller than said characteristic maximum penetration depth; and wherein a principal constituent of the second anode layer has a larger atomic ordinal number than a principal constituent of the first anode layer.

2. An X-ray tube according to claim 1, wherein the principal constituent of the second anode layer is one of tungsten, hafnium, platinum and rhenium, and the principal constituent of the first anode layer is one of rhodium, palladium, chromium, copper, molybdenum and silver.

3. An X-ray tube according to claim 2, wherein the second anode layer is made of tungsten and has a thickness of not more than 0.5 micrometers, and the first anode layer is made of rhodium and has a thickness of between 0.8 and 1.0 micrometers.

4. An X-ray tube according to any previous claim, wherein the carrier layer is made of beryllium and has a thickness of between 150 and 800 micrometers.

5. An X-ray tube according to claim 1, 2, or 3, comprising a filtering layer on the other side of the second anode layer than the enclosure, said filtering layer being adapted to filter out undesired wavelengths of X-ray radiation generated in the material of the second anode layer under bombardment of accelerated electrons.

6. An X-ray tube according to claim 5, wherein the filtering layer is the same as the first anode layer.

7. An X-ray tube according to claim 5, comprising a standalone filter attached to an output of the X-ray tube.

8. An X-ray fluorescence analyzer, comprising:

a controllable X-ray source adapted to controllably illuminate a target with incident X-rays, a detector adapted to receive X-rays from the target, and processing electronics adapted to process output signals obtained from the detector;

wherein the controllable X-ray source is an X-ray tube of end window type and comprises a layered anode arrangement on an inner surface of an end window, the material of an innermost anode layer of the layered anode arrangement having a characteristic maximum penetration depth of electrons accelerated in the X-ray tube, and the thickness of the innermost anode layer being smaller than said characteristic maximum penetration depth; and wherein a principal constituent of the innermost anode layer has a larger atomic ordinal number than a principal constituent of another anode layer of the layered anode arrangement.

9. An X-ray fluorescence analyzer according to claim 8, wherein the processing electronics comprise scattering relation processing means adapted to utilise detected scattering of characteristic peak radiation in a target and spectral mapping means adapted to detect the presence of fluorescent radiation of particular wavelengths in the X-rays received from the target, the spectral mapping means being programmed to take into account high-energy bremsstrahlung coming from said innermost anode layer, and the scattering relation processing means being programmed to take into account characteristic peaks of X-rays coming from a further anode layer in the end window.

* * * * *